US005752542A

United States Patent [19]

Hoeptner, III

[11] Patent Number: 5,752,542

[45] Date of Patent: May 19, 1998

[54] BACK FLOW PREVENTING ADJUSTABLE VALVE APPARATUS

[76] Inventor: Herbert W. Hoeptner, III, 15085 Venetian Way, Morgan Hill, Calif. 95037

[21] Appl. No.: 589,647

[22] Filed: Jan. 22, 1996

[51] Int. Cl.[6] ..... F16K 24/00; E03C 1/10

[52] U.S. Cl. ..... 137/218; 137/360; 137/614.2

[58] Field of Search ..... 137/218, 360, 137/614.2

[56] References Cited

U.S. PATENT DOCUMENTS

| | | | |
|---|---|---|---|
| 196,384 | 10/1877 | Porteous . | |
| 519,728 | 5/1894 | McGowan . | |
| 1,786,357 | 12/1930 | Miller . | |
| 1,987,883 | 1/1935 | White et al. . | |
| 2,174,743 | 10/1939 | Groeniger . | |
| 2,580,199 | 12/1951 | Schmid . | |
| 2,598,488 | 5/1952 | Bart . | |
| 2,598,968 | 6/1952 | Boosey . | |
| 2,605,781 | 8/1952 | Schmid et al. . | |
| 2,664,096 | 12/1953 | Murdock et al. . | |
| 2,940,464 | 6/1960 | Moen . | |
| 3,017,896 | 1/1962 | Papacek . | |
| 3,155,107 | 11/1964 | Woodford . | |
| 3,158,170 | 11/1964 | Tubbs . | |
| 3,171,423 | 3/1965 | Dillon . | |
| 3,470,898 | 10/1969 | Langdon | 137/218 |
| 3,770,003 | 11/1973 | Uroshevich . | |
| 3,858,599 | 1/1975 | Carlson . | |
| 3,885,585 | 5/1975 | Carpentier . | |
| 3,929,150 | 12/1975 | Flinner et al. | 137/218 |
| 3,952,770 | 4/1976 | Botnick . | |
| 4,109,671 | 8/1978 | Hughes et al. . | |
| 4,117,856 | 10/1978 | Carlson . | |
| 4,209,033 | 6/1980 | Hirsch et al. | 137/218 |
| 4,221,233 | 9/1980 | Botnick | 137/218 |
| 4,653,521 | 3/1987 | Fillman . | |
| 4,653,522 | 3/1987 | Fillman et al. . | |
| 4,658,852 | 4/1987 | Weingarten . | |
| 4,669,497 | 6/1987 | Tenhengel . | |
| 4,726,390 | 2/1988 | Franklin . | |
| 4,854,339 | 8/1989 | Hoeptner, III . | |
| 4,909,270 | 3/1990 | Enterante, Sr. et al. . | |
| 4,976,279 | 12/1990 | King, Sr. et al. . | |
| 5,033,500 | 7/1991 | Hoeptner, III . | |
| 5,094,261 | 3/1992 | Giacomini . | |
| 5,228,470 | 7/1993 | Lair et al. . | |
| 5,228,471 | 7/1993 | Hoeptner, III . | |
| 5,355,907 | 10/1994 | Hoeptner, III . | |
| 5,392,805 | 2/1995 | Chrysler | 137/218 |

*Primary Examiner*—Gerald A. Michalsky
*Attorney, Agent, or Firm*—William W. Haefliger

[57] ABSTRACT

In a valving assembly, the combination comprising an outer tubular member having a first flow port; an inner member having closure means thereon to close the port in relatively axially advanced position of the inner member, and to open the port in relatively axially retracted position of the inner member; control means to control relative movement of the inner member between the positions; an axially movable check valve positioned about the axis of the inner member to pass fluid flow from the port and to space defined between the members, and to block reverse fluid flow from the space and through the first port in the inner member relatively retracted position; and a second port to pass fluid from the space in relatively retracted position of the inner member, thereby to relieve pressure of the fluid in the space.

8 Claims, 4 Drawing Sheets

BACK FLOW PREVENTING ADJUSTABLE VALVE APPARATUS

BACKGROUND OF THE INVENTION

This invention relates generally to valves usable to deliver water from housing or building plumbing lines. More particularly, it concerns improvements to such valves, simplifying their construction, and enhancing their performance.

There is need in such valves for improvements associated with blocking or checking back flow where reverse flow pressure may build up. Also, there is need in such valves for disposing of built-up back flow pressure, as during checking or blocking of such back flow to the building plumbing. Such back flow, if unchecked, could contaminate water in that plumbing.

The existing hydrants rely on a plunger to slide and shut off on a seat, by spring force alone. If the spring force is too strong it restricts flow; and if the spring force is too weak, or if the plunger is corroded into the housing, it will not properly slide and shut off on the seat. If the plunger does not effectively slide and shut off on the seat (to act as a check valve), it will not prevent backflow, backsiphonage or relieve backpressure. Also, existing hydrants might pass the ASSE 1019 requirements when new but would likely fail the requirements after a short period of "in field use". After three years it was found in a survey that about 68% of such hydrants failed to pass the ASSE 1019 tests.

SUMMARY OF THE INVENTION

It is a major object of the invention to provide an improved, compact, simple, highly effective back flow preventing valving assembly, meeting the above need. Basically, the assembly includes a) an outer tubular member having a first flow port, b) an inner member having closure means thereon to close the port in relatively axially advanced position of the inner member, and to open the port in relatively axially retracted position of the inner member, c) control means to control relative movement of the inner member between those positions, d) an axially movable check valve positioned about the axis of the inner member to pass fluid flow from the port and to drain flow space defined between the members, and to block reverse fluid flow from that space and through the first port, in the inner member relatively retracted position, and e) a second port to pass fluid from that space in relatively retracted position of the inner member, thereby to relieve pressure of the fluid in the space.

As will appear, the inner and outer members are typically elongated, and a flange may be provided on the outer member, remote from the first port, to engage a structural wall. A hollow valve body is provided to carry the inner and outer members, and an adjustment handle may be carried by the hollow valve body to adjust the inner member between relatively advanced and retracted positions, the handle positioned remotely from the closure means.

A further object is to provide the second port in association with the inner member to pass fluid from the space defined between the members, and into the inner member in selectively advanced position of the latter.

Yet another object is to provide the check valve in the form of an annular elastomeric cup, having an annular lip which is deflectable, and which engages a bore defined by the outer member. The closure means may include a carrier, a stopper carried by said carrier, the carrier telescopically carried by said inner member, to move axially relative thereof, and said check valve also carried by said carrier, to move axially relative to said inner member.

The present invention does not require a spring to influence closure, because the check valve shuts off on the wall of the hydrant as the check valve moves axially. Further, this check valve does not require a specific seat location to shut off. It can shut off anywhere on the wall of the hydrant. Thus, the present inventive design enables the check valve to operate at any position within the tubular wall of the hydrant. Therefore it will always act as a check valve and prevent backsiphonage and backpressure. Also, a spring is not required because the pressure differential across the check valve will itself displace the plunger. For example, when a 60 psi supply drops to 0 psi, there is a 60 psi differential across the 0.75 inch diameter check valve. This translates into a 27 lb. force, forcing the plunger and opening the vent hole. This structure will ensure that the plunger opens, even if corroded in the housing, and will relieve backpressure. The only way to get that level of force, in prior designs, was to have a 27 lb. spring which would or could drastically restrict the flow.

These and other objects and advantages of the invention, as well as the details of an illustrative embodiment, will be more fully understood from the following specification and drawings, in which:

DRAWING DESCRIPTION

DETAILED DESCRIPTION

Figure 1:
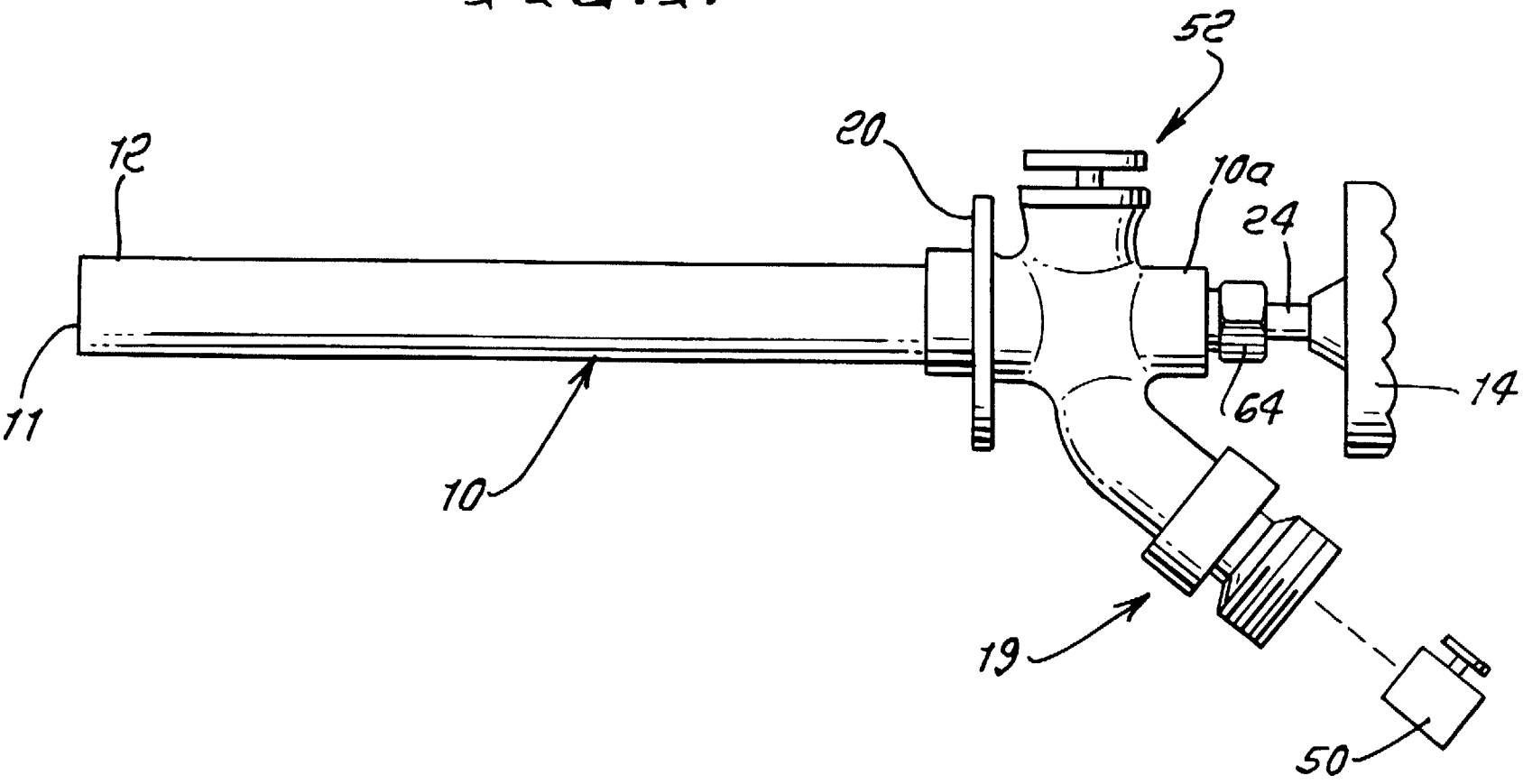
FIG. 1 is an external elevation showing a valve assembly incorporating the invention.

In the drawings, an outer tubular member as at 10 has a first flow port 11 at one end of the member. A female fitting 12 at that end is adapted to receive a male pipe end 13 (see FIG. 4) to which water pressure is communicated at 13*a* typically at about 60 psi. When a control means such as valve handle 14 is rotated in one direction, a closure means such as a valve stopper or plug 15 is backed away from a seat 15*a* in member 10, allowing pressurized water from 13 to flow past check valve 16, in bore 17, and then to flow via space 18 to fitting 19, as for delivering water from plumbing in a residence. See FIG. 2. A flange 20 on the member 10 is engageable with a wall 21 of the building, to position member 10 in a bore 22 in that wall.

Figure 4:
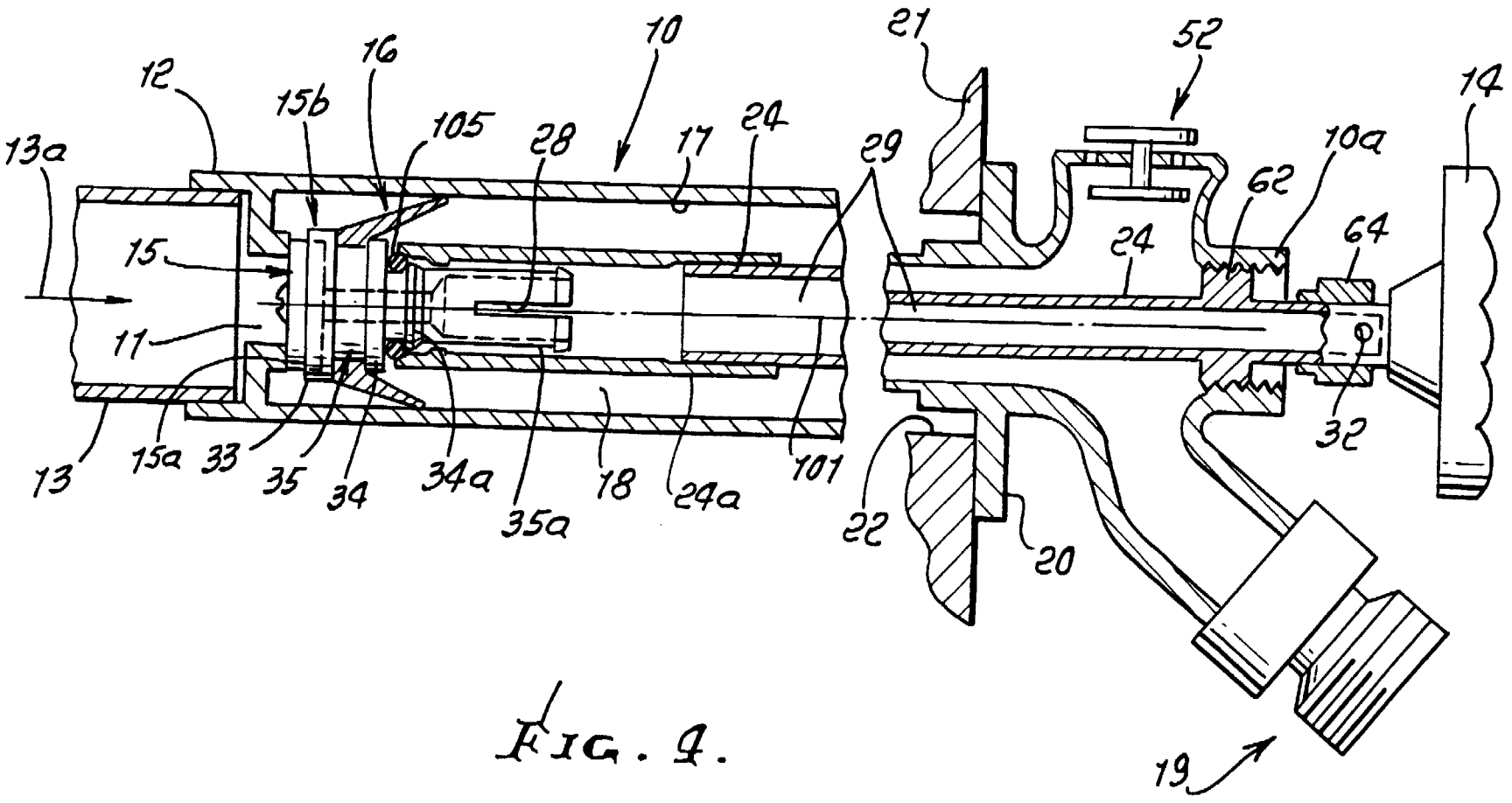
FIG. 4 is a view like FIG. 2, but showing the valve in OFF condition.

The closure assembly 15*b* is carried by an elongated inner member 24, which in its leftward advanced position, of FIG. 4 is urged against the seat. In rightward retracted position of FIG. 2 the member 15 is spaced from the port 11 to open the latter.

Figure 2:
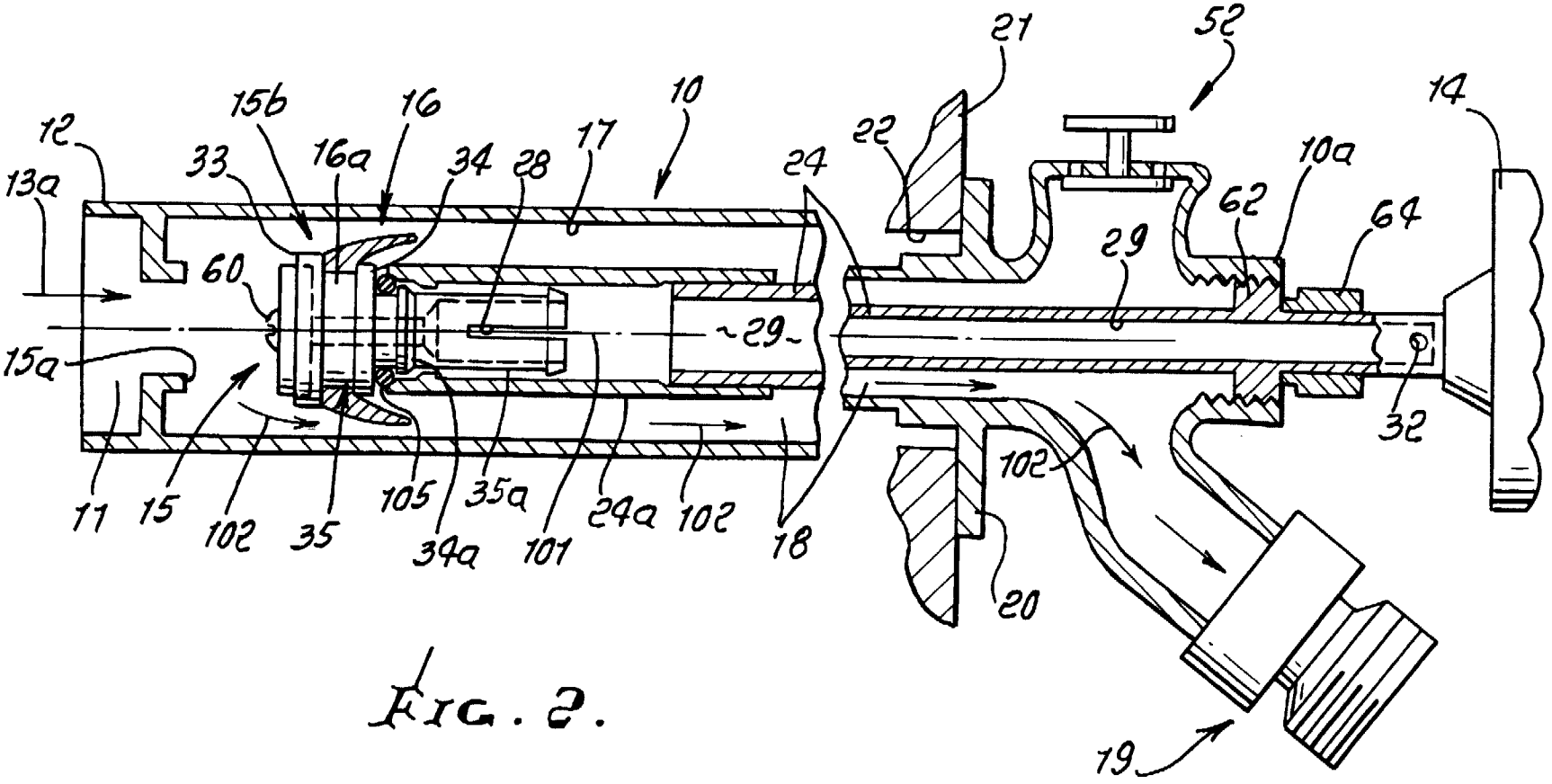
FIG. 2 is a vertical side elevation taken through the FIG. 1 assembly, to show internal construction; the valve being in flow passing open (ON) condition.

Check valve 16 is shown as annular, to be positioned about the axis 101 of inner member 24. It is configured to deflect and to pass the flow rightwardly, as referred to above (see flow arrows 102 in FIG. 2), and to block reverse fluid flow (back-flow) from space 18 leftwardly past the check valve and to and through first port 11, as in FIG. 3 ON position. Thus, potentially contaminating back flow as from a hose via fitting 19 to port 11 is prevented. In this regard, handle OFF position is seen in FIG. 4, and handle ON position is seen in FIGS. 2 and 3.

Figure 3:
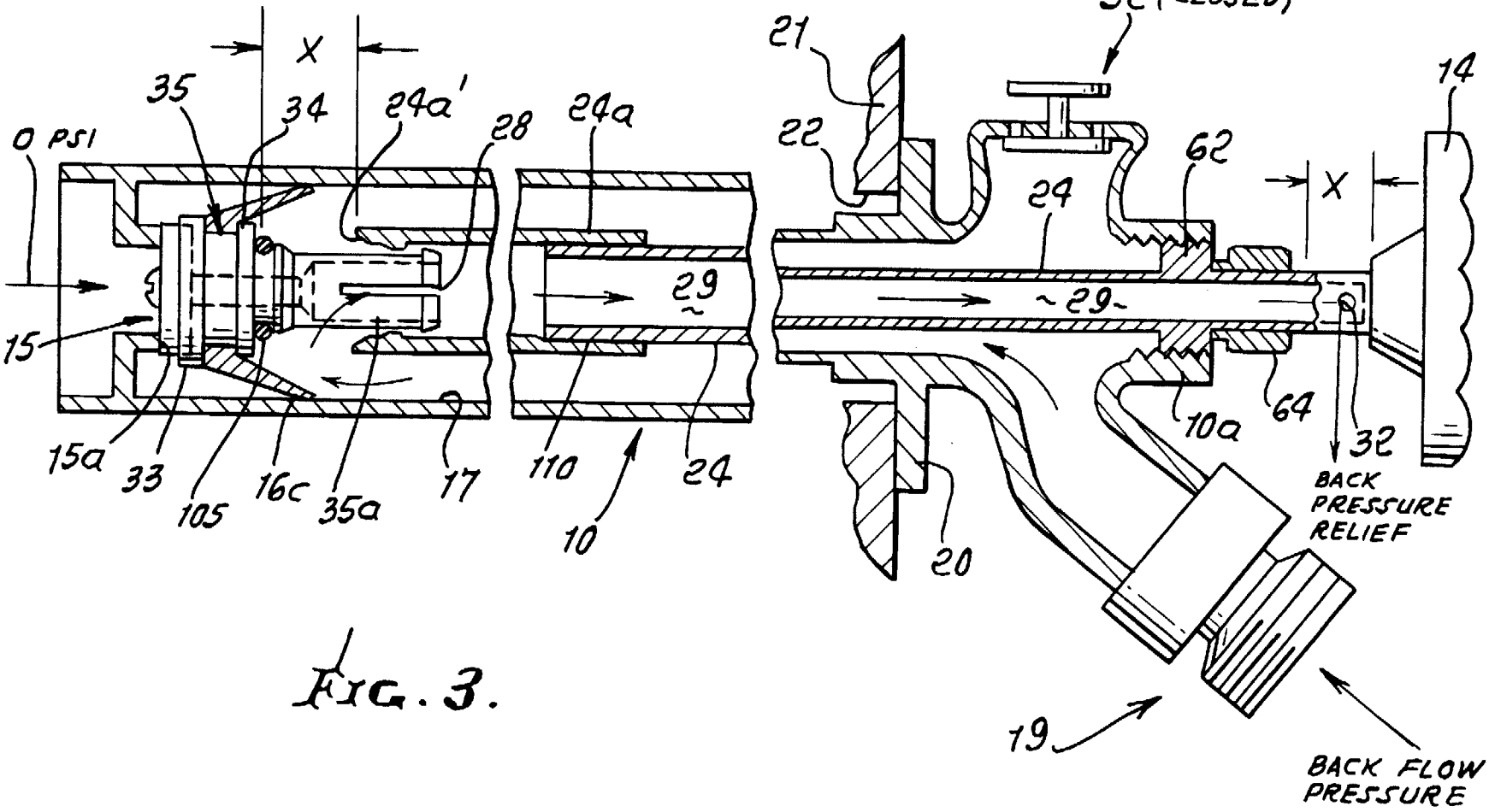
FIG. 3 is an enlarged section like FIG. 2, showing the valve assembly in ON condition, with backflow and backpressure being relieved.

In accordance with an important feature of the invention, a second port is provided, as at 28, to pass back-flow fluid from space 18, as in FIG. 3, to relieve build-up of pressure of fluid in that space. As shown in FIG. 3, second port 28 is provided by an axially extending slot 28 in the side wall of a tubular stem extension 35*a* of a body 35 that carries 16. Stem extension 35*a* slides telescopically in a sleeve extension 24*a* of tubular member 24. As seen in FIG. 3, fluid in passage 18 flows via slot 28 into the elongated bore or passage 29 in 24. Fluid may escape from the passage 29 as via a side port 32 near handle 14. Port 32 leads to the exterior. Port or slot 28 is not exposed to space 18 when flow from first port 11 passes rightwardly past the check valve as in FIG. 2, i.e. port 28 is then covered, since extension 35*a* is then retracted rightwardly by flow pressure into sleeve extension 24*a* on 24. See FIG. 2. However, if backpressure builds up in space 18, as in FIG. 3, check valve 16 is then pushed to the left, uncovering the port 28, to allow escape or relief of backpressure to space 18. In FIGS. 3 and 4, stopper 15 has sealed against seat 15*a*.

Note in this regard the positioning of the check valve inner annular body 16*a* between two flanges 33 and 34 on axially movable body 35 that carries closure or stopper 15 at the leftward end of body 35. Body 35 carries an O-ring 105 between flange 34 and flange 34*a*, to seat at tapered seat end 24*a*' of extension 24*a*, as in FIG. 2, thereby isolating slot 28 from passage 18. As shown in FIG. 2, pressurized drain flow cannot escape via slit port 28 to the bore 29 of member 24. However, when back-flow pressure dominates (in open condition of the valve handle), it forces valve 16 to the left, carrying body 35 to the left, and slit port 28 then becomes exposed to passage 18, due to travel of O-ring 16*a* leftwardly away from the tapered seat end of sleeve 24*a*. Back flow pressure can then be relieved via slit port 28 and bore 29 to the exterior.

Note that check valve 16 has a frusto-conical annular lip 16*c* with an edge wiping annularly against bore 17, when moved leftwardly to FIG. 3 position. No spring is required to move valve 16 leftwardly.

A fastener 60 is shown extending axially to retain stopper 15 plate to flange 33 of assembly 15*b*, allowing its replacement, after a threaded plug 62 is removed from the rightward barrel end 10*a* of 10. A nut 64 on 62 allows such plug removal. Plug 62 is integral with 24 to threadably engage 10*a* for advancing and retracting 24 as the handle is turned.

FIG. 1 also illustrates a valve 50 in series with drain fitting 19; and FIGS. 2–4 show an air pressure relief control at 52, in the side of member 10, near the handle.

FIG. 3 shows a solder joint at 110, between 24 and 24*a*.

I claim:

1. In a valving assembly, the combination comprising a) an outer tubular member having a first flow port, b) an inner member having closure means thereon to close said port in relatively axially advanced position of said inner member, and to open said port in relatively axially retracted position of said inner member, c) control means to control relative movement of the inner member between said positions, d) an axially bodily movable check valve positioned about the axis of the inner member to pass fluid flow from said port and to space defined between said members, and to block reverse fluid flow from said space and through said first port in said inner member relatively retracted position, and e) a second port to pass fluid from said space in said relatively retracted position of the inner member, thereby to relieve pressure of the fluid in said space, f) said closure means including a carrier, a stopper carried by said carrier, the carrier telescopically carried by said inner member, to move axially relative thereof, and said check valve also carried by said carrier, to move axially relative to said inner member, said inner member being tubular, said second port defined by said carrier to pass fluid from said space into the inner member in said relatively retracted position of the inner member, h) said check valve sealing on a bore in said outer member and at times when fluid passes from said space into the inner member, i) and wherein said check valve comprises an annular elastomeric cup having an annular deflectable lip engaging a bore defined by said outer member.

2. The combination of claim 1 wherein said members are endwise elongated, and including a flange on the outer member remote from said first port, to engage a structural wall.

3. The combination of claim 1 including a hollow valve body carrying said members, and an adjustment handle carried by said body to adjust said inner member between said relatively advanced and retracted positions.

4. The combination of claim 3 wherein said members are longitudinally elongated, and said handle is located remotely from said closure means.

5. The combination of claim 3 wherein said valve body has a flow fitting in communication with said space via said hollow valve body.

6. The combination of claim 1 wherein said closure means and said check valve are movable as a unit.

7. The combination of claim 1 wherein said carrier includes a tubular stem telescopically slidable axially in said inner member, said stem defining said second port.

8. The combination of claim 1 wherein said closure means and said check valve provide double sealing when the control means has been moved to ON condition of the valve, and backflow pressure is exerted on the check valve.

* * * * *